US009068482B2

(12) United States Patent
Methley

(10) Patent No.: US 9,068,482 B2
(45) Date of Patent: Jun. 30, 2015

(54) SPOOL VALVE

(75) Inventor: Ian Methley, Oxfordshire (GB)

(73) Assignee: MECHADYNE INTERNATIONAL LIMITED, Oxfordshire (GB)

( * ) Notice: Subject to any disclaimer, the term of this patent is extended or adjusted under 35 U.S.C. 154(b) by 192 days.

(21) Appl. No.: 13/979,378

(22) PCT Filed: Jan. 6, 2012

(86) PCT No.: PCT/IB2012/050078

§ 371 (c)(1),
(2), (4) Date: Jul. 12, 2013

(87) PCT Pub. No.: WO2012/095772

PCT Pub. Date: Jul. 19, 2012

(65) Prior Publication Data

US 2013/0284134 A1 Oct. 31, 2013

(30) Foreign Application Priority Data

Jan. 14, 2011 (GB) ..... 1100632.7

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34423* (2013.01); *F01L 2001/34426* (2013.01); *F01L 2001/3443* (2013.01); *F01L 2001/34489* (2013.01)

(58) Field of Classification Search
CPC ..... F01L 2001/34496; F01L 2001/34489; F01L 2001/34426; F01L 1/3442; F01L 2001/3443; F01L 2001/34433; F01L 1/344; F01L 2001/34493; F16K 11/02
See application file for complete search history.

(56) References Cited

U.S. PATENT DOCUMENTS

| | | | | |
|---|---|---|---|---|
| 5,627,418 | A | 5/1997 | Satomi et al. | |
| 6,247,436 | B1 | 6/2001 | Lancefield et al. | |
| 6,571,757 | B1 | 6/2003 | Simpson | |
| 6,725,817 | B2 | 4/2004 | Methley et al. | |
| 7,444,968 | B2 * | 11/2008 | Lancefield et al. | 123/90.17 |
| 7,503,293 | B2 | 3/2009 | Lettmann et al. | |
| 7,610,890 | B2 | 11/2009 | Lettmann et al. | |
| 2003/0111033 | A1 | 6/2003 | Kim | |
| 2004/0216710 | A1 | 11/2004 | Owen et al. | |
| 2007/0119402 | A1 * | 5/2007 | Lancefield et al. | 123/90.17 |
| 2007/0295296 | A1 | 12/2007 | Lettmann et al. | |
| 2009/0272349 | A1 | 11/2009 | Methley et al. | |
| 2013/0000576 | A1 * | 1/2013 | Tanaka et al. | 123/90.15 |

FOREIGN PATENT DOCUMENTS

| | | | |
|---|---|---|---|
| GB | 2 401 150 | A | 11/2004 |
| WO | WO 2006/067519 | A1 | 6/2006 |

* cited by examiner

*Primary Examiner* — Thomas Denion
*Assistant Examiner* — Daniel Bernstein
(74) *Attorney, Agent, or Firm* — Norman B. Thot

(57) ABSTRACT

A spool valve for controlling a twin phaser for coupling a drive member to two driven members and to enable the phase of the two driven members to be varied independently includes a bore operably associated with the twin phaser, fluid channels opening into the bore, and a spool. The spool is received in and is moveable relative to the bore so as to selectively open and close the fluid channels in a predetermined manner, thereby providing a fluid communication between the spool and the twin phaser, and varying a phase of output members relative to an input member. The spool and the fluid channels are configured so that an axial displacement of the spool relative to the bore serves to control a phase of a first output member, and a rotation of the spool relative to the bore serves to control a phase of a second output member.

15 Claims, 11 Drawing Sheets

SPOOL VALVE

CROSS REFERENCE TO PRIOR APPLICATIONS

This application is a U.S. National Phase application under 35 U.S.C. §371 of International Application No. PCT/IB2012/050078, filed on Jan. 6, 2012 and which claims benefit to Great Britain Patent Application No. 1100632.7, filed on Jan. 14, 2011. The International Application was published in English on Jul. 19, 2012 as WO 2012/095772 A1 under PCT Article 21(2).

FIELD

The invention relates to a spool valve and particularly to a spool valve for controlling a twin phaser operable for coupling a drive member for rotation with two driven members and for enabling the phase of each of the two driven members to be varied independently in relation to the drive member.

BACKGROUND

A twin phaser can be used in an internal combustion engine in the drive train from the engine crankshaft to camshaft lobes operating on two different sets of gas exchange valves of the engine. The two sets may be the intake valves and the exhaust valves, respectively. Alternatively, in an engine with multiple valves per cylinder, both sets of valves may be valves of the same type, e.g., intake valves. The present invention is primarily concerned with the construction of the twin phaser and not with the manner in which the two outputs are used in any specific application.

Various designs of phaser have been proposed in the prior art which are operated mechanically, electrically or hydraulically. The present invention relates to hydraulically controlled phasers, examples of which are vane-type phasers. In vane-type phasers, a radial vane connected to one of two members of which the relative phase is to be varied, separates two working chambers within an arcuate cavity defined by the other member.

Twin phasers that are controlled hydraulically generally need four separate oil feeds, as each of the two outputs requires a hydraulic supply line and a return line. Connecting four oil feeds to the cam phaser is complicated because four sealed interfaces are required between the moving parts on the cam/phaser and the stationary parts on the engine.

The same problem is experienced not only with phasers that are hydraulically operated, i.e., that rely on an external pressure supply, but also with other types of phaser, such as, for example, with phasers that rely on differential pressures in the working chambers of the phaser resulting from torque reversals and clutch type phasers as described in EP1216344.

The term "hydraulically controlled" is intended to include all of these phaser types.

Connecting four oil feeds or control lines to a cam phaser can be achieved using an oil-feed manifold, mounted to the front cover and connected to the front of the cam phaser, as described, for example, in U.S. Pat. No. 6,247,436 and in GB 2,401,150. On occasions, however, there is not the packaging space for this to be achieved, especially in an overhead camshaft application. Furthermore, it may be undesirable in some cases to feed pressurised oil through passageways in the front cover.

It has also previously been proposed to construct the oil feeds so that they pass through the camshaft via grooves and passageways formed in the cam bearings. As is discussed below, this approach also raises certain issues.

FIG. 11 of U.S. Pat. No. 7,610,890 (Mahle) shows four adjacent radial grooves cut into the front camshaft bearing. This proposal requires a very large or long front cam bearing to accommodate the four feeds and enough area for it to still act as a bearing surface.

FIG. 1 of U.S. Pat. No. 7,503,293 (Mahle) shows how the two front bearings in a concentric camshaft can be used to convey oil to a twin phaser. In this layout, there are increased opportunities for leakage as oil can leak out of slots in tube 6 where pin 7 moves. The complexity of this proposal also has cost implications.

FIG. 2 of US 2007/0295,296 (Mahle) shows yet another alternative way of conveying the four oil feeds.

It is preferred for the design of the hydraulic control system to reduce the number of oil feeds to the phaser. For a single-output cam phaser, it has been suggested that if the oil control/spool valve is integrated into the body of the cam phaser (rather than having it somewhere in the cylinder head or cylinder block), then only a single oil feed is required.

U.S. Pat. No. 6,571,757 shows such an integrated spool design for a cam-torque actuated cam phaser where a single spool valve is located on the axis of the phaser and its axial position is controlled by an actuator mounted onto the front cover. By moving the spool valve axially, different oil channels are connected and the phaser advances or retards.

This type of design is suitable for a single-output phaser but it is relatively complex for a dual-output device because the front actuator needs to control the axial position of two in-line spool valves independently. Gaining access to the rear spool valve and being able to package two spool valves in line within the confines of the phaser envelope presents difficulty.

U.S. Pat. No. 7,444,968 shows a twin-spool design for a dual independent torque actuated phaser.

SUMMARY

An aspect of the present invention is to provide a hydraulically controlled twin phaser for mounting on a camshaft in which hydraulic fluid is supplied to control the phaser from the camshaft end of the phaser and in which the phaser can be actuated via a control input from its opposite end to control the phase of the two output members of the phaser independently of one another.

In an embodiment, the present invention provides a spool valve for controlling a twin phaser for coupling a drive member to two driven members and for enabling a phase of each of the two driven members to be varied independently relative to the drive member which includes a bore configured to be operably associated with the twin phaser, fluid channels opening into the bore, and a spool. The spool is configured to be received in and be moveable relative to the bore so as to selectively open and close the fluid channels in a predetermined manner so as to provide a fluid communication between the spool and the twin phaser so as to vary a phase of output members relative to an input member. The spool and the fluid channels are configured so that an axial displacement of the spool relative to the bore serves to control a phase of a first output member, and a rotation of the spool relative to the bore serves to control a phase of a second output member.

BRIEF DESCRIPTION OF THE DRAWINGS

The present invention is described in greater detail below on the basis of embodiments and of the drawings in which.

DETAILED DESCRIPTION

In an embodiment of the present invention, a spool valve is provided for controlling a twin phaser of the type operable to couple a drive member for rotation with two drive members and for enabling the phase of each of the two driven members to be varied independently relative to the driven member, the spool valve comprising a spool dimensional to be received in the bore which is operable and associated with the said twin phaser, wherein the spool is operable to selectively open and close a plurality of fluid channels in a predetermined manner to provide fluid communication between the spool and the said twin phaser to thereby vary the phase of the said output members relative to the said input member, whereby axial displacement of the spool relative to the said bore controls the phase of one of the output members and rotation of the spool relative to the said bore controls the phase of the other output member In an embodiment of present invention, a twin phaser is provided for coupling a drive member for rotation with two driven members and for enabling the phase of each of the two driven members to be varied independently in relation to the drive member, wherein the twin phaser comprises a spool valve as described in the preceding paragraph.

In an embodiment of the present invention, a valve mechanism is provided for an internal combustion engine having a twin phaser as described in the preceding paragraph.

In the present invention, a spool valve is used to control the hydraulic connections of two groups of control ports of the phaser, to a supply line and a return line. The valve spool has two degrees of freedom, namely axial translation and rotation. Each degree of freedom serves to control a respective one of the two output members of the phaser. The two degrees of freedom are totally independent of one another, inasmuch as the spool can be rotated when in any axial position and can be moved axially when in any angular position. This allows the position and orientation of a single valve spool to set the phases of both output members of the phaser independently of one another.

In an embodiment of the present invention, the operably associated bore which receives the spool is defined by a sleeve that is rotatably received within the phaser, enabling the components of the spool valve, namely the spool and the surrounding sleeve to be held stationary and moved relative to one another as the remainder of the phaser rotates.

In an embodiment of the present invention, the operably associated bore which receives the spool is defined by the phaser and there is no intermediate sleeve. In this embodiment, the spool rotates in use with the phasers and an actuator (or two separate actuators) is used to vary its axial and angular position relative to the main body of the phaser while the phaser rotates.

Figure 1:
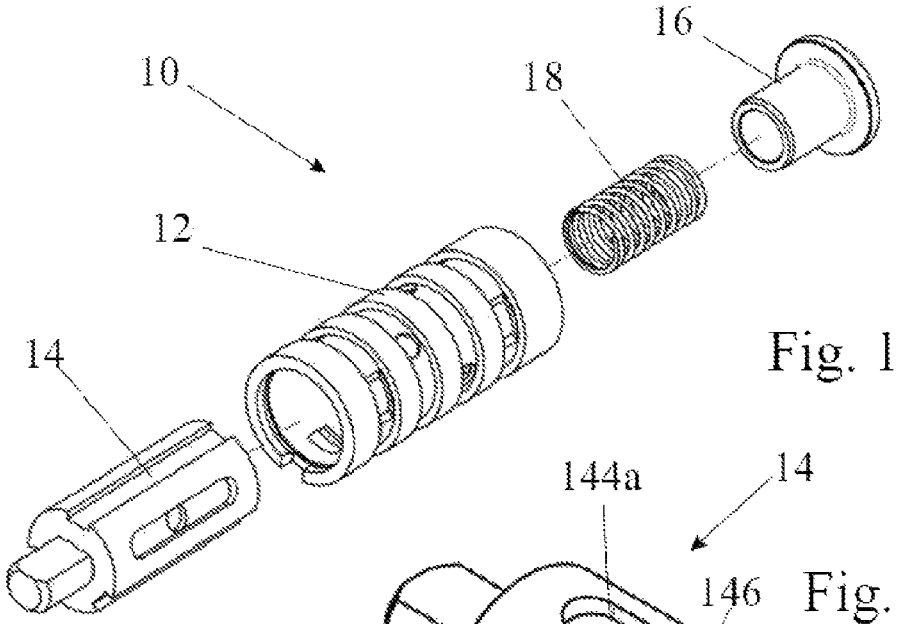
FIG. 1 is an exploded view of a spool valve assembly for a twin phaser.
Figure 2:
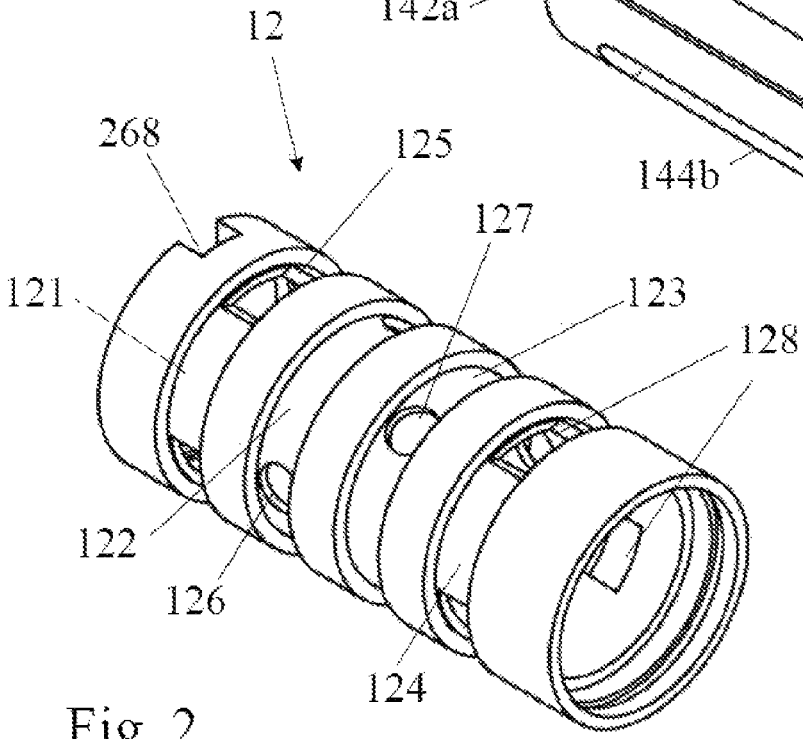
FIG. 2 is a perspective view of the outer sleeve of the spool valve assembly shown in FIG. 1.

Referring to FIG. 1, a spool valve 10, according to the present invention, for controlling a hydraulic twin phaser, comprises an outer sleeve 12, a valve spool 14 and a feed sleeve 16. The outer sleeve 12 and the valve spool 14 are shown to an enlarged scale in FIGS. 2 and 3.

The outer sleeve 12 is a tube with four annular grooves 121,122,123 and 124 on its outer surface. Each of the grooves (121, 122, 123 and 124), in use, communicates with a respective one of four control lines of a hydraulic twin phaser, as will be described in more detail below. Ports 125, 126, 127 and 128 in the respective grooves 121, 122, 123 and 124 allow hydraulic fluid to flow between the grooves and the inside of the outer sleeve 12 when the ports are not covered by the valve spool 14.

The valve spool 14 is formed from a cylinder that fits within the outer sleeve 12, the fit of the cylinder being such that it will slide and move axially in the sleeve 12, but will prevent fluid flow through any of the ports 125 to 128 that are covered at any time by the spool 14. The spool has a hollow blind bore 141 that receives the feed sleeve 16 at its open end. The cylinder has at its blind end a projection 148 that can be acted upon by an actuator to set the position of the valve spool 14 relative to the outer sleeve 12.

The outer surface of the valve spool 14 is formed with three grooves 142*a*, 142*b* and 142*c* that extend over the entire length of the cylinder from one end to the other. These grooves, which will be referred to by the generic reference numeral 142, are uniformly circumferentially staggered around the outer surface of the cylinder. The outer surface of the valve spool 14 is formed with three further axial grooves 144 (only two of the grooves 144*a* and 144*b* being seen in FIG. 3) that extend over only part of the length of the cylinder. The grooves 144 are similarly distributed uniformly about the circumference of the cylinder and alternate with the grooves 142. An opening 146 in each of the grooves 144 allows hydraulic fluid to flow into the grooves 144 from the blind bore 141.

Figure 4:
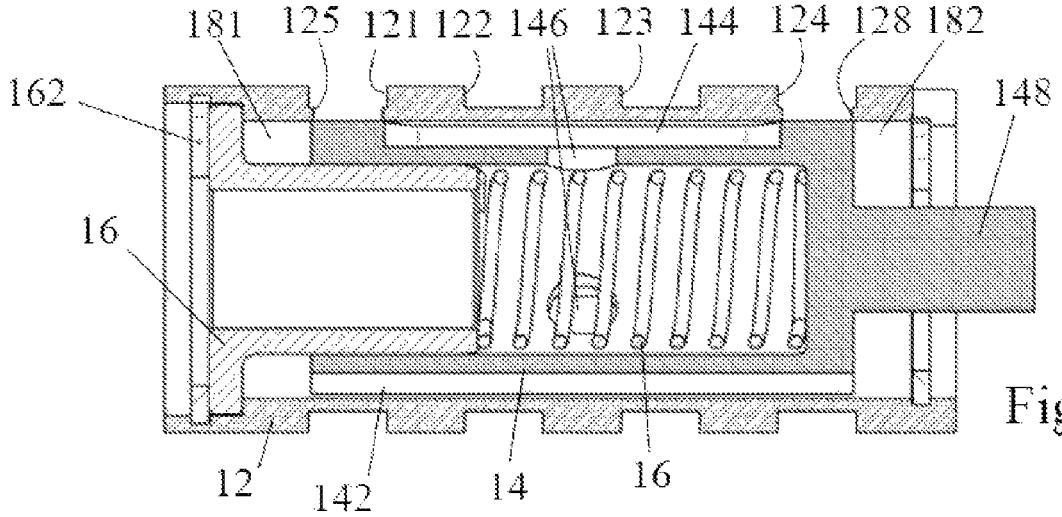
FIGS. 4, 5 and 6 are sections through the spool valve assembly of FIGS. 1 to 3 in its assembled state showing the effect of axial displacement of the valve spool relative to the valve outer sleeve.
Figure 5:
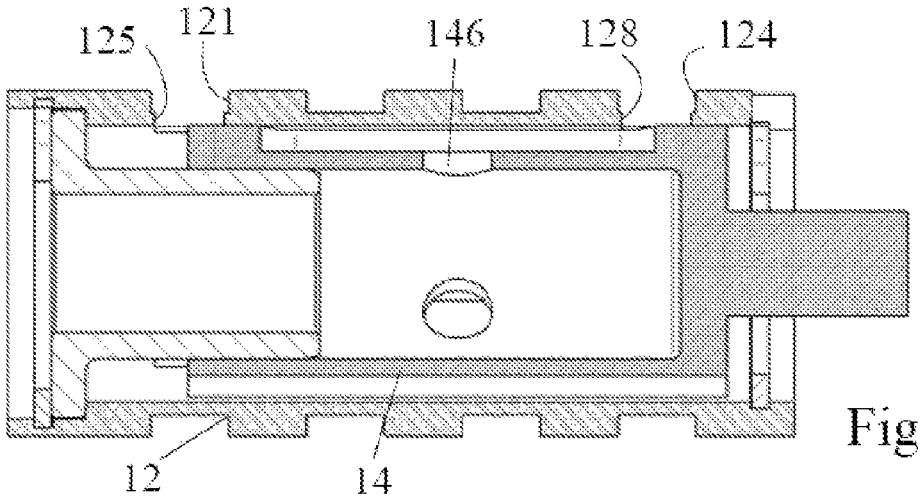
Figure 6:
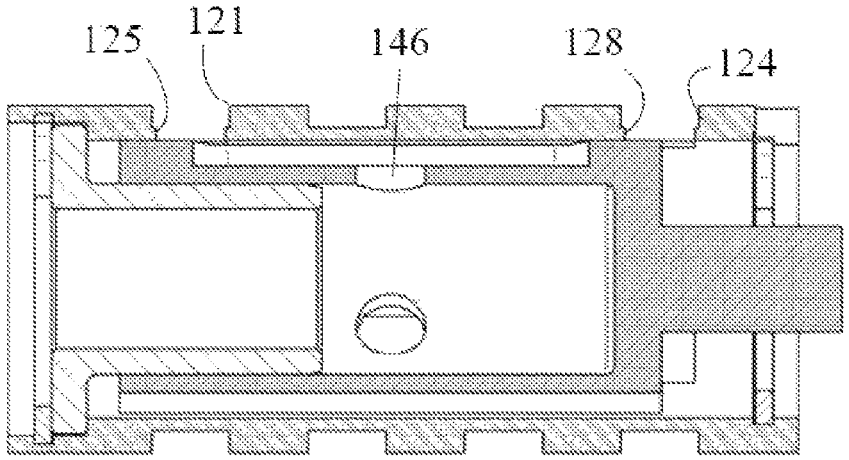

In the assembled valve, as shown in FIGS. 4 to 6, the feed sleeve 16, through which hydraulic fluid under pressure enters the spool valve assembly 10, slidingly fits within the open end of the valve spool 14 and is held in the outer sleeve 12 by a circlip 162. Annular chambers 181 and 182 at opposite ends of the valve spool 14 communicate with one another at all times through the grooves 142, and fluid can escape from the spool valve assembly 10 through the chamber 182 to drain into an engine front cover. As shown in FIGS. 4 to 6, fluid can drain into a front engine cover from the chamber 182, but it is alternatively possible to have a return line in the camshaft to communicate with the chamber 181.

In use, two control lines of the twin phaser controlling a first of the two output members communicate permanently with the grooves 121 and 124, while two further lines controlling the second output member communicate with the grooves 122 and 123.

The control of the first output member of the phaser is effected in the manner shown in FIGS. 4, 5 and 6 by an axial displacement of the valve spool 14. FIG. 4 shows that the ports 125 and 128 are covered by the outer surface of the valve spool 14. In this position, hydraulic fluid can neither be supplied to nor drained from any of the working chambers associated with the first output member and its phase is therefore hydraulically locked relative to that of the driven member.

Movement of the valve spool 14 to the right as shown in FIG. 5, results in the ports 128 being connected to the pressurised grooves 144 and the ports 125 being connected to a return path for the hydraulic fluid. In particular, the return fluid enters the chamber 181 and flows through the grooves 142 into the chamber 182 from which it can drain into the front cover of the engine. Conversely, as shown in FIG. 6, movement of the valve spool 14 to the left causes the ports 125 to be connected to the pressurised grooves 144 and the ports 128 to be connected to the oil drain path via chamber 182.

Figure 7A:
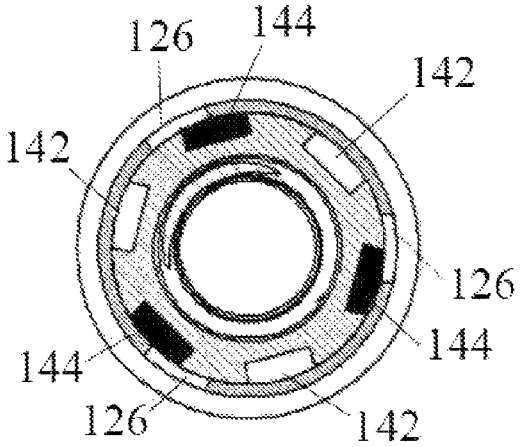
FIGS. 7*a*, 7*b*, 8*a* and 8*b* are sections showing the effect of rotating the valve spool relative to the outer sleeve.
Figure 7B:
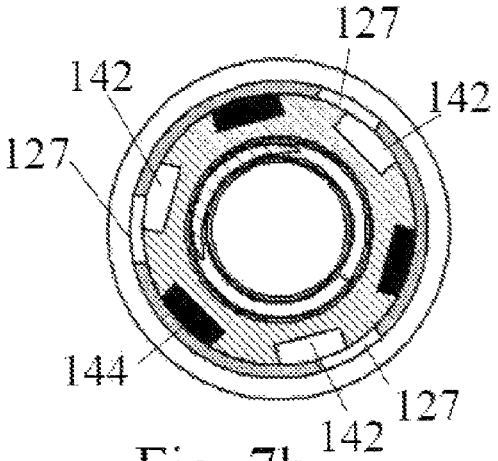
Figure 8A:
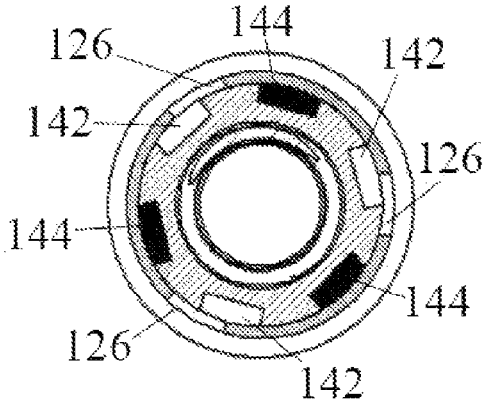
Figure 8B:
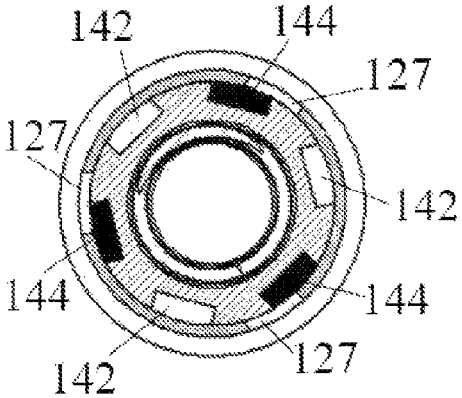

FIGS. 7*a* and 8*a* are sections through a plane passing through the ports 126 in the groove 122 of the outer sleeve 12, whereas FIGS. 7*b* and 8*b* are sections through a plane passing through the ports 127 in the groove 123, these ports 126 and 127 being connected to the control lines associated with the second output member of the phaser. These Figures show the effect of rotating the valve spool 14 relative to the outer sleeve 12. The three shorter grooves 144 that are pressurised are shown with solid shading and act as supply grooves while the return grooves 142 are shown unshaded and provide a drainage path. It can be seen from FIGS. 7*a* and 7*b* that in one angular position of the valve spool 14, the ports 126 are connected to the supply channel 144 and the ports 127 are connected to drain channel 142 causing the phase of the second output member to be varied in one sense. Conversely, as shown in FIGS. 8*a* and 8*b*, rotation of the valve spool 14 can result in the ports 126 being connected to the drain channel 142 and the ports 127 to the supply channel 144, causing the phase to be varied in the opposite sense.

Figure 9:
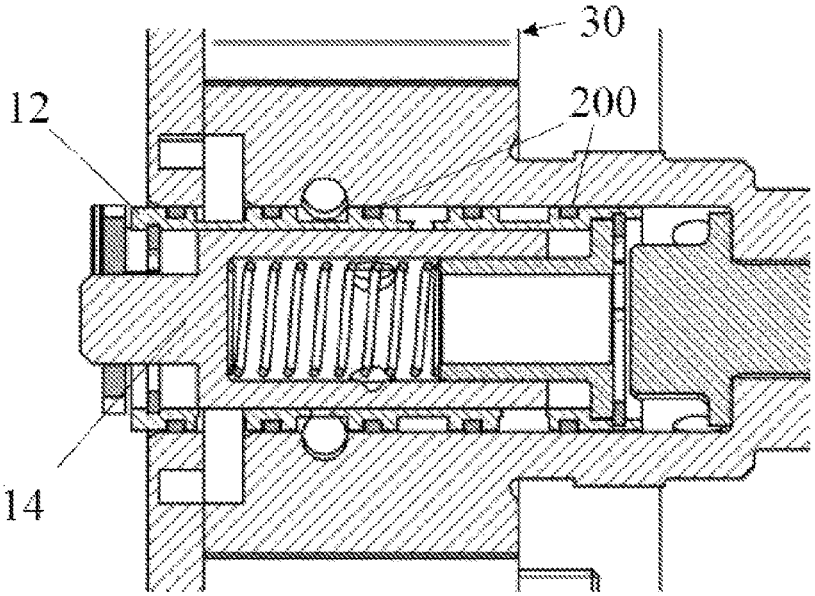
FIGS. 9, 10, 11 and 12 show different modifications that may be made to the basic design of the spool valve assembly.

FIG. 9 shows that seals 200 can be arranged on the outer surface of the outer sleeve 12 to isolate the control ports from one another as the stator 30 of the phaser rotates while the outer sleeve 12 is held stationary.

Figure 10:
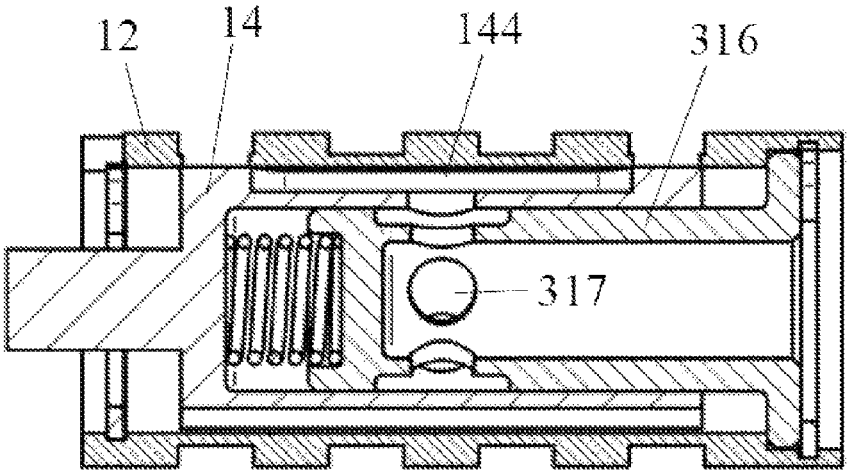

To avoid the pressure of the hydraulic fluid applying a biasing force to the valve spool 14, it is possible, as shown in FIG. 10, to form the feed sleeve 316 with a blind bore that communicates only with the shorter grooves 144 through openings 317. This avoids changes in the supply pressure affecting the position of the valve spool 14.

Figure 11:
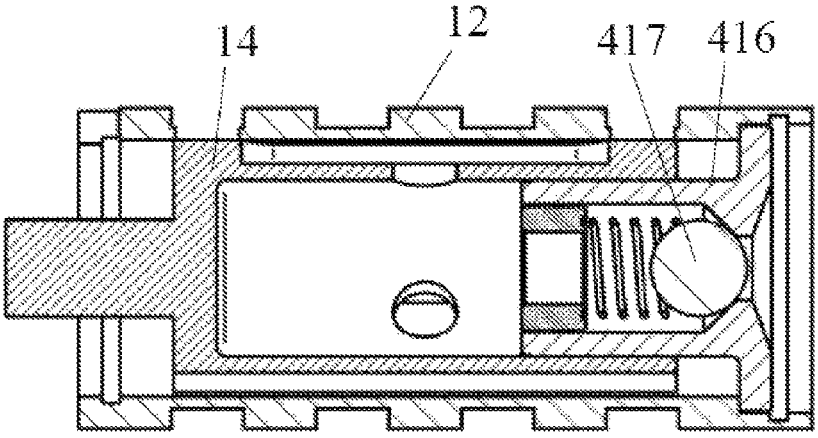

In the embodiment of FIG. 11, the feed tube 416 is formed with a non-return valve 417. This allows the working chambers of the phaser to remain under pressure even when the supply pressure drops and prevents any instantaneous high pressures in the phaser overcoming the supply pressure.

Figure 12:
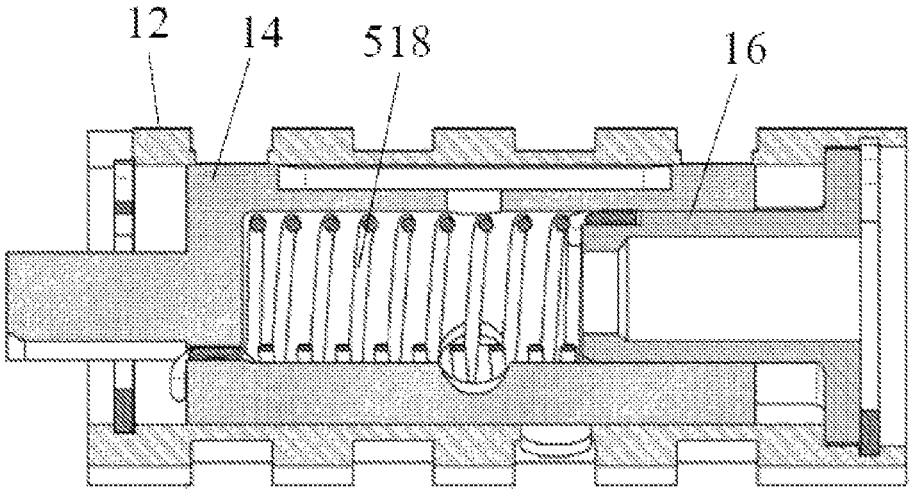

In the embodiment of FIG. 12, the same spring 518 is used to function as a torsion spring to apply a torque to the valve spool 14 and as a compression spring to urge the valve spool 14 to the left, as viewed. It should also be noted that instead of using one or more springs, one can rely on friction and the rotation of the phaser to bias the valve spool rotationally.

Figure 13:
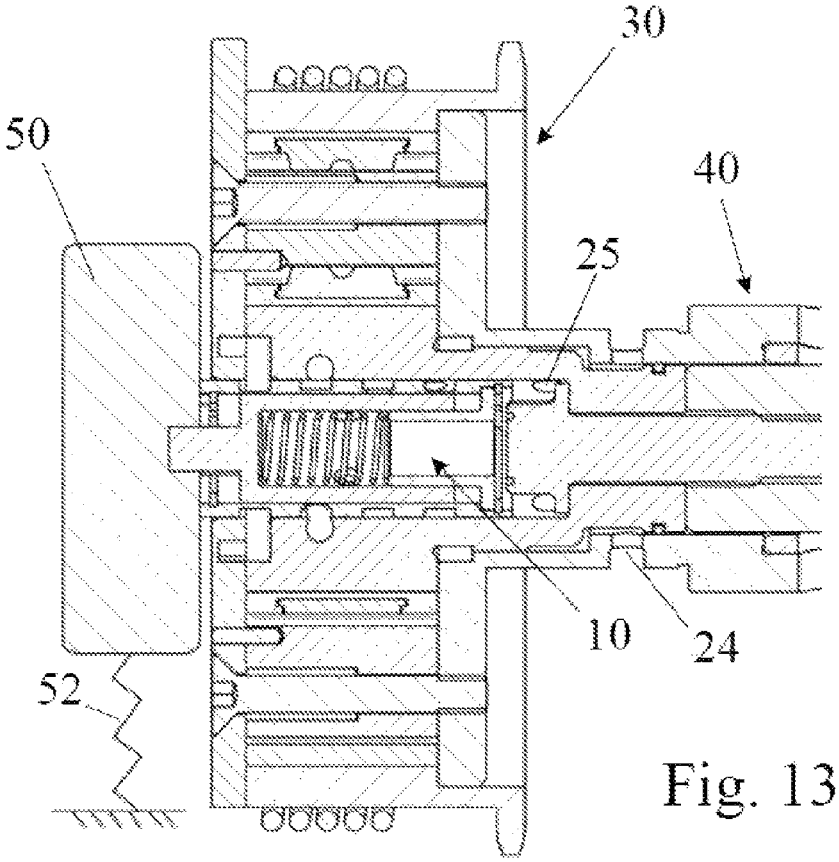
FIG. 13 is a section through a twin phaser fitted with a spool valve assembly and a single actuator for both rotating and axially displacing the valve spool.
Figure 14:
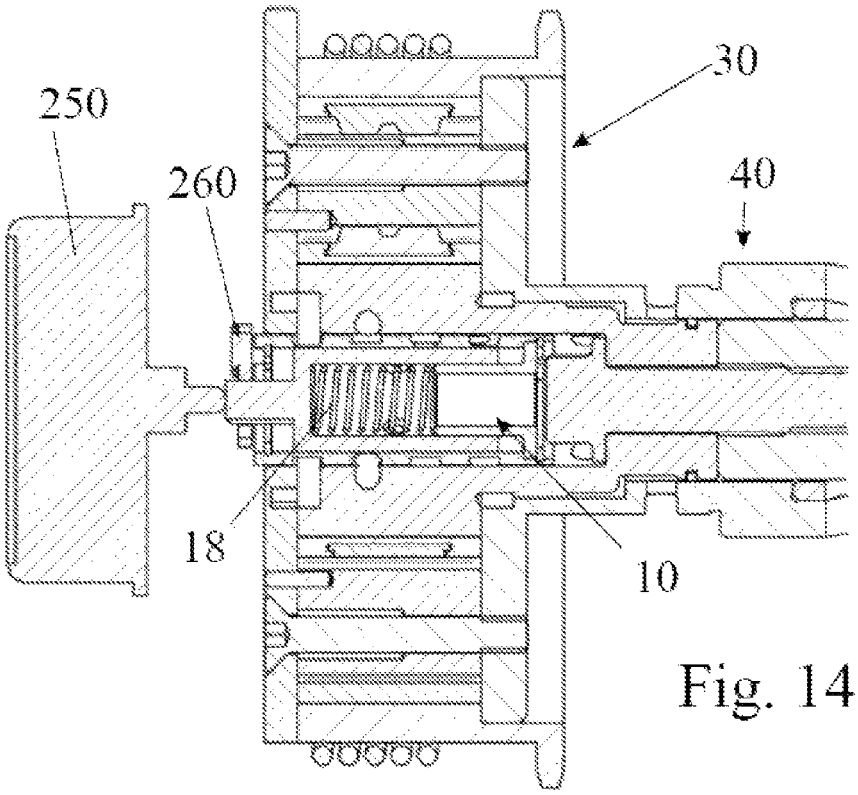
FIG. 14 is a section through an alternative embodiment of twin phaser in which separate actuators are used to control the phases of the output members, a first actuator serving to displace the valve spool axially while the second serves to rotate it.

FIG. 13 shows a cross section through an assembled camshaft 40, a twin-vane phaser 30, spool valve assembly 10 and an actuator assembly 50. The design of the assembled camshaft 40 and twin-vane phaser 30 will not be described herein. The design of twin-vane phasers is furthermore described in, for example, U.S. Pat. No. 6,725,817 and WO 2006/067519.

Likewise, the design of an assembled concentric camshaft, also sometimes referred to as a single cam phaser (SCP) camshaft, is described in several earlier patent documents. Such an assembled camshaft has an outer tube fast in rotation with a first set of cam lobes on which outer tube there is also mounted a second set of cam lobes that can rotate relative to the outer tube. An inner shaft rotatably mounted within the outer tube is connected for rotation with the second set of cams by means of pins that pass through arcuate slots in the outer tube. The inner shaft and the outer tube are connected to the two driven members of the phaser of which the drive member is rotated by the crankshaft. In this way, the phaser allows the phase of each set of cam lobes to be adjusted independently relative to the engine crankshaft.

The spool valve assembly 10 is concentric with the camshaft axis. Pressurised oil is fed to the spool valve assembly 10 via a groove 24 in the front cam bearing and is fed to the inner part of the spool valve assembly via drillings 25 in the rotor of the phaser.

The actuator 50 is used to axially displace and to rotate the spool valve relative to its sleeve for independent control of the two pairs of oil feed lines of the phaser that control the respective output members. Such an actuator may take the form of the combined linear-rotary actuator as described in U.S. Pat. No. 5,627,418.

The spool valve assembly 10 in this embodiment remains stationary while the camshaft 40 and phaser 30 rotate relative to it. The spool valve assembly 10 sits in a close running clearance bore in the cam nose for sealing purposes. Because of this close running clearance and the possible run out of the phaser, it is expected that the actuator 50 may need to be mounted on flexible mounts 52 so that the system is not over-constrained.

The internal construction of the phaser, the spool valve assembly 10 and the camshaft 40 in FIGS. 14 to 18 is essentially the same as that of FIG. 13. The difference in this embodiment of the present invention is that separate actuators 250 and 260 are used for axial displacement and rotation of the valve spool 14. The axial displacement actuator 250 can operate electrically, mechanically, hydraulically or pneumatically and serves only to push on the end of the valve spool 14 against the action of the return spring 18.

Figure 15:
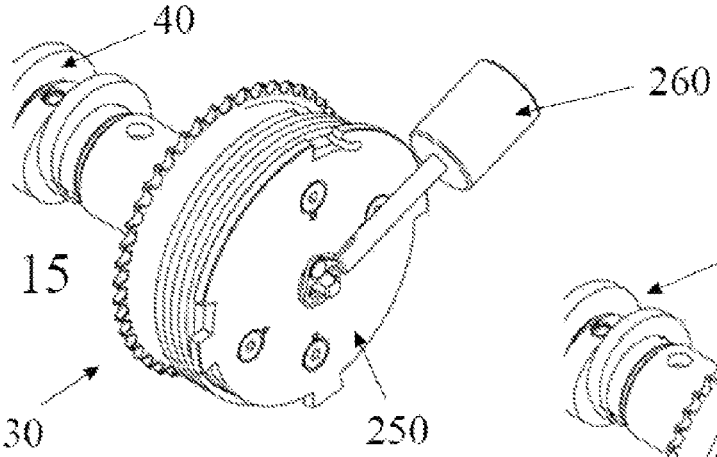
FIG. 15 is a perspective view of the embodiment of FIG. 14 with the first actuator removed.
Figure 16:
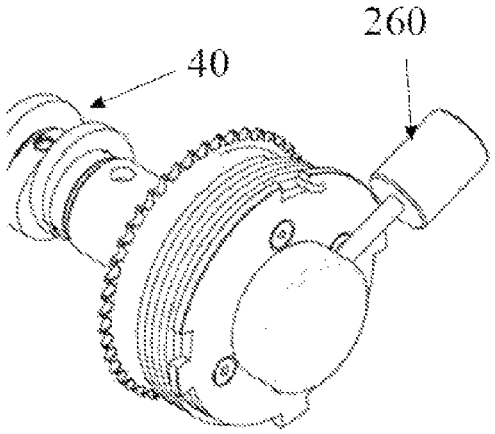
FIG. 16 is a perspective view of the twin phaser shown in FIG. 14.
Figure 17:
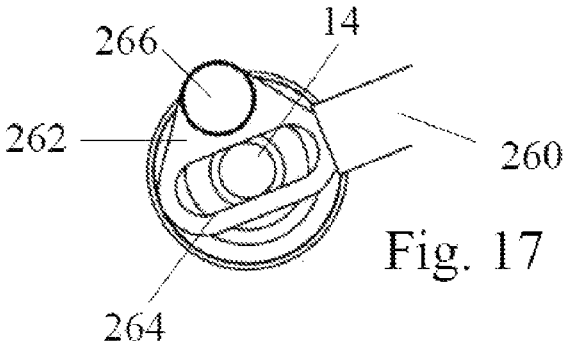
FIG. 17 shows a detail of the coupling between the second actuator in FIGS. 15, 16 and the spool valve assembly.

The rotation of the valve spool 14 relative to the sleeve 12 is effected by a second linear actuator 260 which is shown more clearly in FIGS. 15 to 17. The end of the actuator 260 carries a plate 262 with an elongated slot 264 that slides over the valve spool 14. A pin 266 projecting from the plate 262 engages in a slot 268 (see FIG. 2) in the end of the outer sleeve 12 to cause it to rotate relative the valve spool 14 as the actuator 260 moves linearly. Furthermore, the rotation of the camshaft 40 could be used to bias the rotation of the outer sleeve 12 to one end of its travel.

Figure 18:
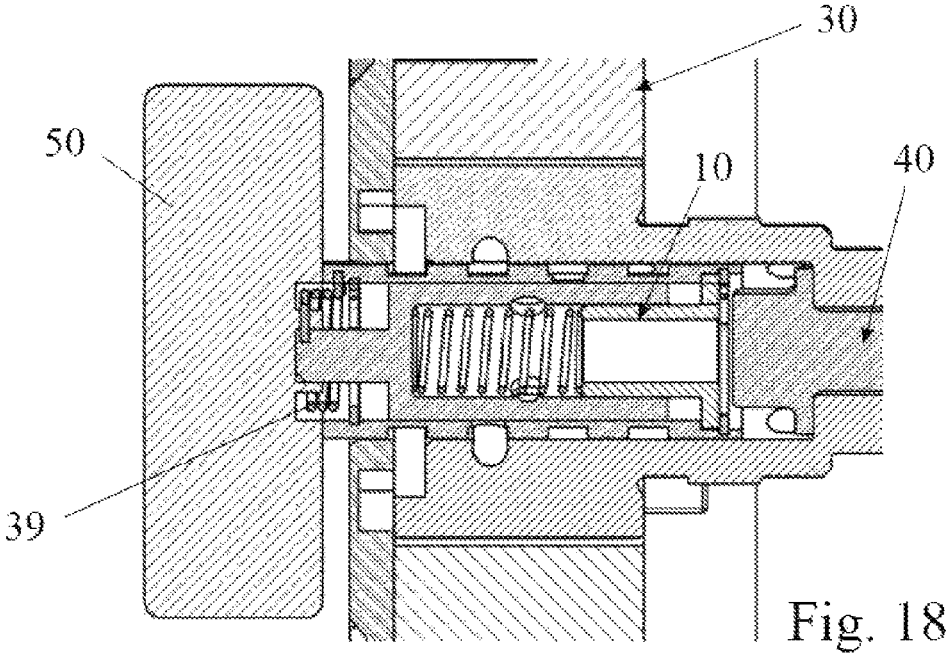
FIGS. 18 to 20 are sections through further different embodiments of the invention.

FIG. 18 shows an embodiment that includes a torsion spring 39, between the valve spool 14 and the outer sleeve 12 to bias the rotation of the spool valve assembly 10 to one end of its travel. This is an alternative to the modification of FIG. 12, where the same spring is used to bias the valve spool 14 both axially and rotationally.

Figure 19:
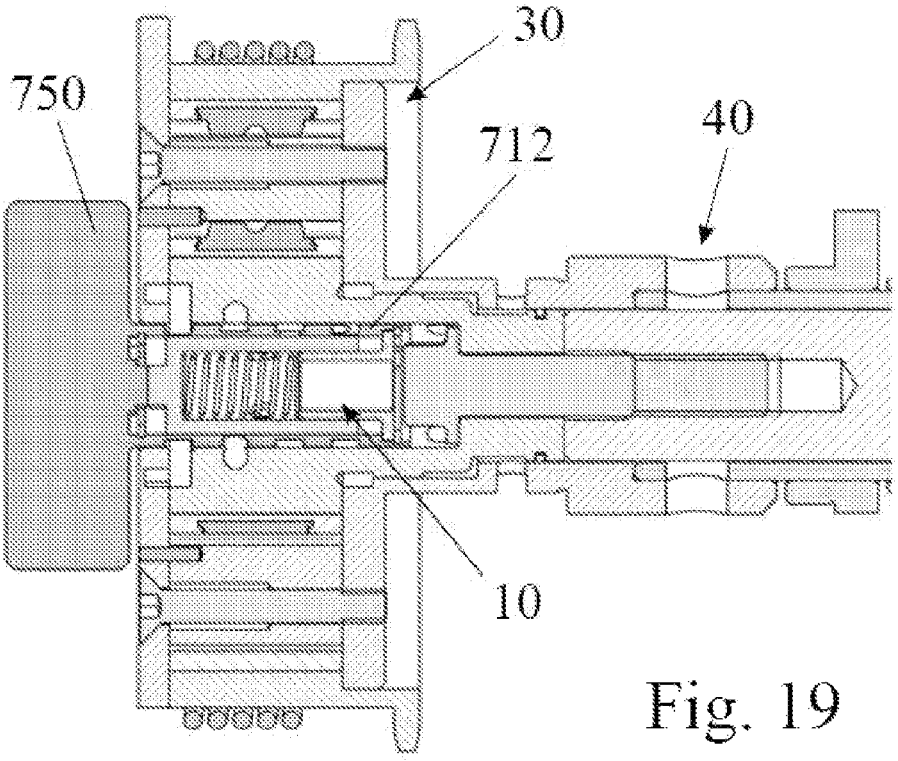

In the embodiment of FIG. 19, the outer sleeve 712 is integrated into the actuator assembly 750 as a one-piece module that is assembled to the engine in a single operation. Such a module could be permanently attached to the inside of the front cover of the engine which would slide into the phaser and the nose of the camshaft 40 when the front cover is mounted onto the engine.

Figure 20:
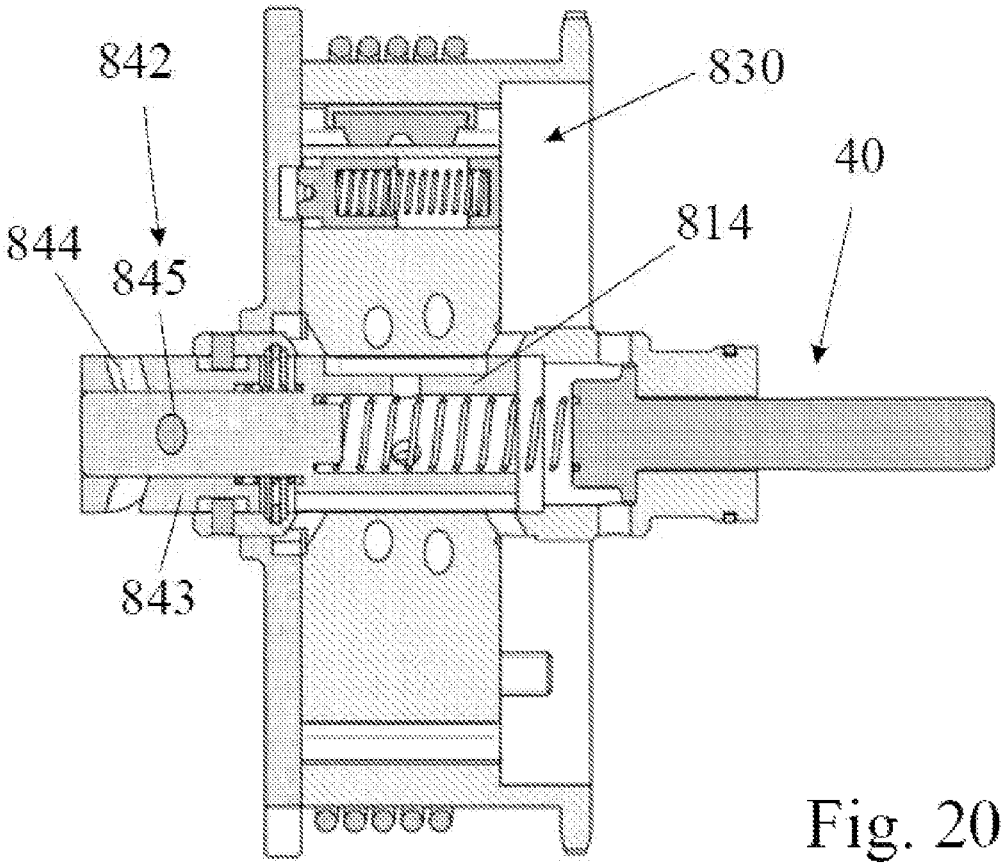
Figure 21:
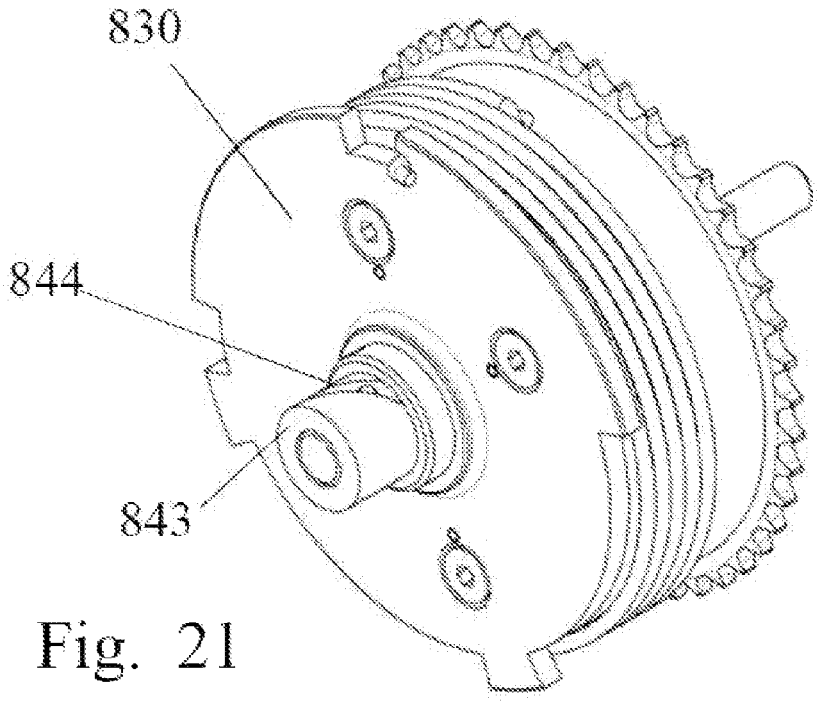
FIG. 21 is a perspective view of the twin phaser of FIG. 20.
Figure 22:
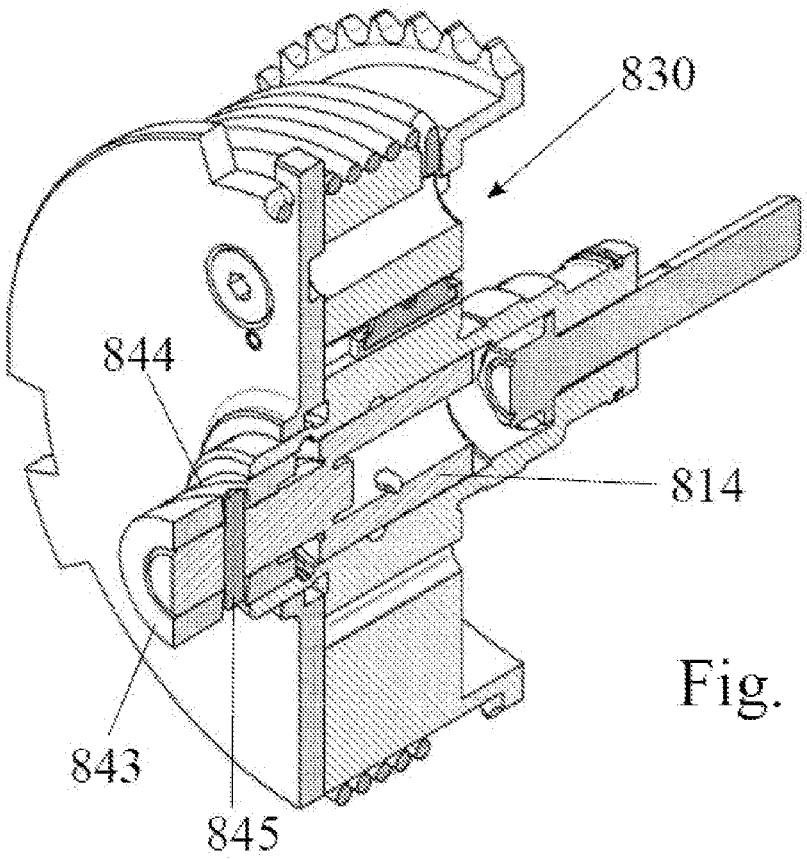
FIG. 22 is a cut-away perspective view of the twin phaser of FIGS. 20 and 21.

The embodiment of FIGS. 20 to 22 differs from those previously described in that the outer sleeve is omitted and the bore receiving the valve spool 814 is defined by the rotor of the phaser 830. A mechanism 842 is provided that allows a twin axial actuator to move the spool valve assembly 10 axially and rotate it relative to the cam nose. This has the added advantage that the spool valve assembly 10 is then integrated within the cam phaser 830.

The mechanism 842 has an outer collar 843, which can only slide relative to the cam nose. This outer collar 843 has a helical slot cut 844, through which a pin 845 protrudes and engages with the modified inner valve spool 814.

When the outer collar 843 is moved axially relative to the valve spool 814, the pin 845 rotates in the slot 844 therefore rotating the valve spool 814. When both the outer collar 843 and the valve spool 814 are moved axially in unison, the valve spool 814 will just move axially and not rotate. In this way, two axial actuators can be used to control the axial and rotational position of the spool relative to the cam nose.

It will be appreciated that other types of linear/rotary actuator may be used to move the valve spool relative to the outer sleeve, such as, for example, the use of a stepper motor, air cylinders, or solenoid actuators.

The spool valve assembly 10 can also be adapted for use with other types of twin phasers. For example, for an axially stacked twin phaser it is advantageous to use a spool having pairs of outputs adjacent to each other.

Figure 23:
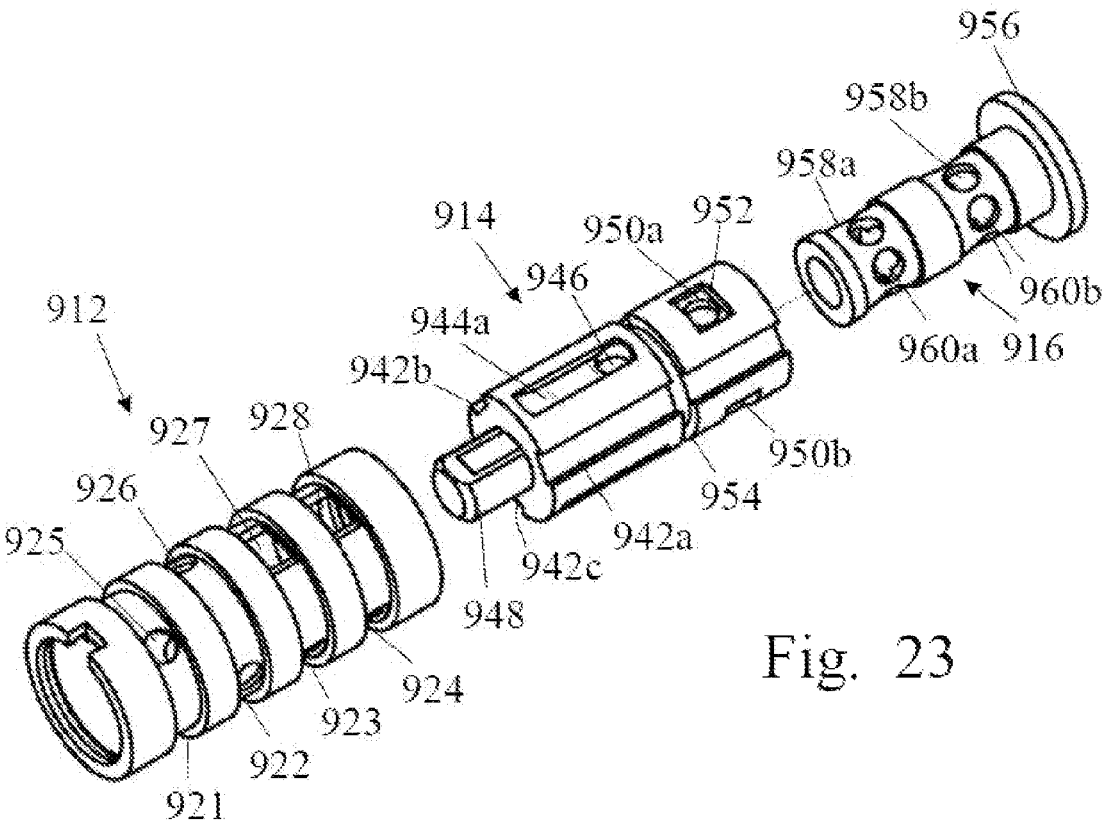
FIG. 23 is an exploded view of an alternative spool valve assembly suitable for use with an axially stacked twin phaser.

FIG. 23 shows an exploded view of an alternative spool valve assembly 910 suitable for use with an axially stacked twin phaser. The spool valve assembly 910 is similar to the spool valve assembly 10 (described in relation to FIGS. 1 to 3) in that it comprises an outer sleeve 912, a valve spool 914 and a feed sleeve 916.

The outer sleeve 912 is a tube with four annular grooves 921, 922, 923 and 924 on its outer surface. Ports 925, 926, 927 and 928 allow hydraulic fluid flow between the grooves (921 to 924) and the inside of the outer sleeve 912 when the ports are not covered by the valve spool 914.

The valve spool 914 is formed from a cylinder that fits within the outer sleeve 912, the fit of the cylinder being such that it will slide and move axially in the outer sleeve 912 but will prevent fluid flow to any of the ports 925 to 928 that are covered at any time by the valve spool 914. The valve spool 914 has a hollow blind bore that receives the feed sleeve 916 through its open end. The valve spool 914 has a projection 948 that can be acted upon by an actuator to set the position of the valve spool 914 relative to the outer sleeve 912.

The outer surface of the valve spool 914 is formed with three grooves 942*a*, 942*b* and 942*c* that extend over the entire length of the valve spool 914 from one end to the other in a direction parallel to the longitudinal axis of the valve spool 914. These grooves, which will be referred to by the generic reference 942, are uniformly circumferentially spaced apart around the outer surface of the valve spool 914.

Figure 3:
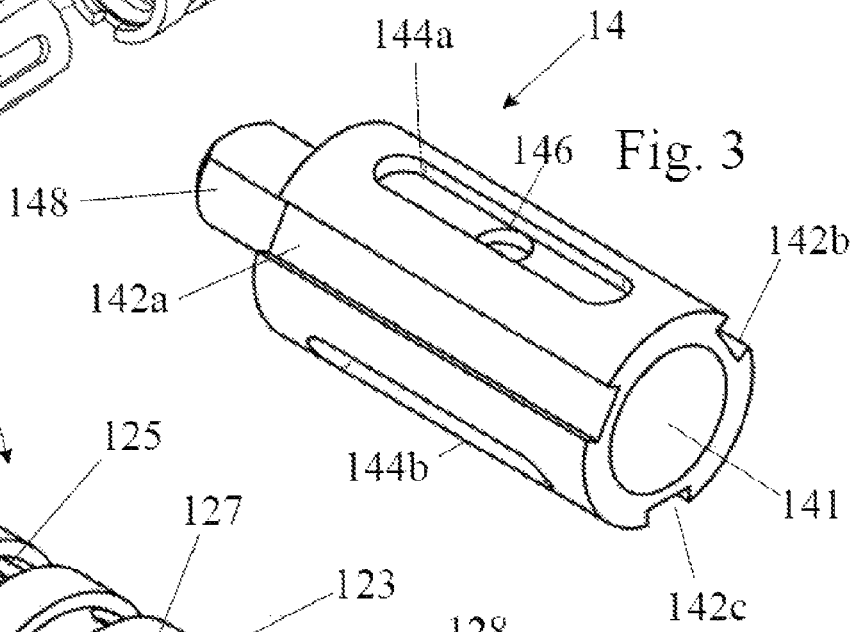
FIG. 3 is a perspective view of the valve spool of the spool valve assembly shown in FIG. 1.

Until now, the valve spool 914 has been similar to the valve spool 14 described in relation to FIG. 3. However, valve spool 914 has a different arrangement of grooves formed on its outer surface.

The outer surface of valve spool 914 is formed with three grooves 944 (only two of the grooves 944*a* and 944*b* can be seen in FIG. 23) that extend over only part of the length of the valve spool 914. The grooves 944 are circumferentially spaced apart around the outer surface of the valve spool 914 and extend in a direction parallel to the longitudinal axis of the valve spool 914 in an arrangement such that they are inter-disposed between adjacent grooves 942. An opening 946 in each of the grooves 944 allows hydraulic fluid to flow between the grooves 944 and the inner bore of the spool.

The outer surface of the valve spool 914 is also formed with three slots 950 (only two of the slots 950*a* and 950*b* can be seen in FIG. 23). The slots 950 are circumferentially spaced apart around the outer surface of the valve spool 914 in an arrangement such that they are inter-disposed between adjacent grooves 942 and aligned with corresponding grooves 944 in a direction parallel to the longitudinal axis of the valve spool 914. An opening 952 in each of the slots 950 allows hydraulic fluid to flow between the slots 950 and the inner bore of the spool.

The outer surface of the valve spool 914 is also formed with a radial groove 954 which extends around the circumference thereof and is disposed between the grooves 944 and the slots 950 such that it is discrete therefrom. The radial groove 954 passes through the longitudinally extending grooves 942 such that they are interconnected therewith.

The feed sleeve 916 is a hollow tube having a flanged end 956. The outer surface of the feed sleeve 916 has two annular grooves 958*a* and 958*b* extending around the circumference thereof. Each annular groove, 958*a* and 958*b*, has a plurality of openings, 960*a* and 960*b*, respectively, circumferentially spaced apart to extend around the complete circumference of each annular groove, 958*a* and 958*b*.

In the spool valve assembly 910, the feed sleeve 916, through which hydraulic fluid under pressure enters the spool valve assembly 910, slidingly fits within the open end of the valve spool 914.

In use, rotation of the valve spool 914 controls the flow of fluid to and from ports 925 and 926 for controlling the first output of the twin phaser and axial motion of the valve spool 914 controls the flow of fluid to and from ports 927 and 928 for controlling the second output of the twin phaser. The radial groove 954 interconnects the grooves 942 which act as exhaust channels. Accordingly, for example, when the valve spool 914 is moved axially towards the flange end 956, of the feed sleeve 916, fluid can exhaust from annular groove 923, of the outer sleeve 912, into the radial groove 954, of the valve spool 914.

Figure 24:
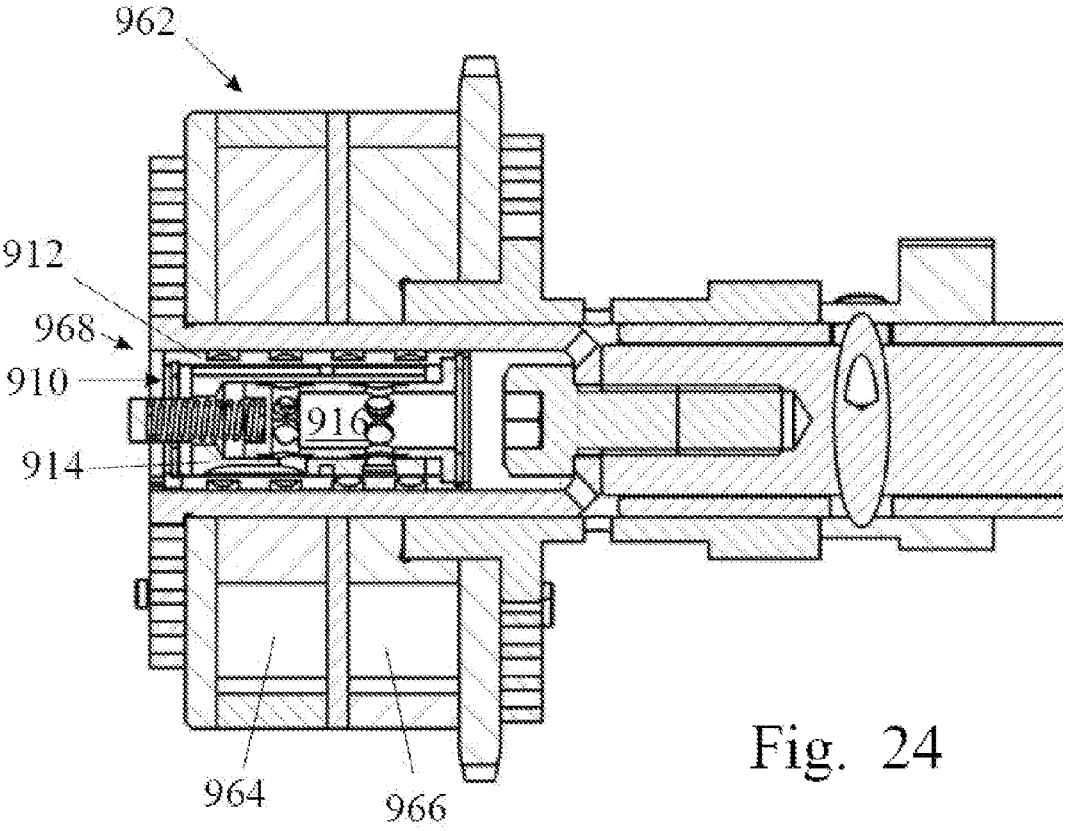
FIG. 24 is a drawing showing a cross section through an axially stacked twin phaser having the spool valve assembly of FIG. 23 fitted.

FIG. 24 shows a cross-section through an axially stacked twin phaser 962 having two axially stacked output rotors, 964 and 966. The spool valve assembly 910 is fitted within a cam nose 968 and, in the position shown, the ports are arranged so that the relevant feed and return channels are aligned for fluid communication with the stacked rotors, 964 and 966.

The spool valve assembly can also be adapted for use with other types of phasers, such as, for example, torque actuated phasers. Torque-actuated phasers require a different fluid circuit compared to the above-mentioned pressure-actuated phasers and therefore require a different spool.

Figure 25:
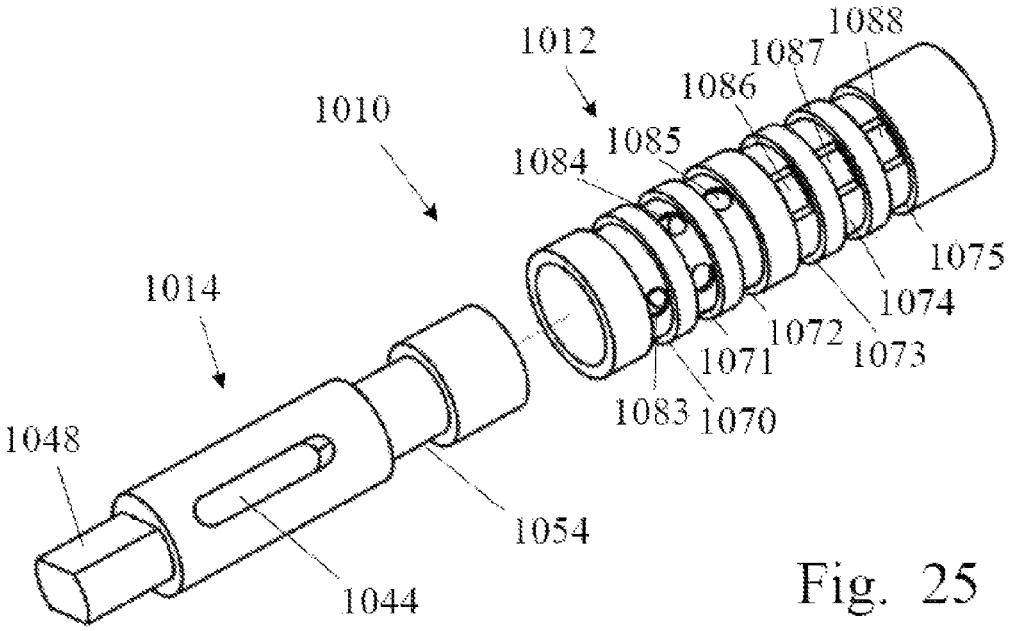
FIG. 25 is an exploded view of a spool valve assembly suitable for use with a torque-actuated phaser.

FIG. 25 shows an exploded view of a torque actuated spool valve assembly 1010, having an outer sleeve 1012 and a valve spool 1014.

The outer sleeve 1012 is a tube with six annular grooves, 1070, 1071, 1072, 1073, 1074 and 1075 on its outer surface. Each of the grooves, in use, communicates with a respective one of six fluid control channels of a torque-actuated phaser. Ports 1083, 1084, 1085, 1086, 1087 and 1088, in the respective grooves 1070, 1071, 1072, 1073, 1074 and 1075, allow fluid to flow between the grooves and the inside of the sleeve 1012 when the ports are not covered by the valve spool 1014.

The valve spool 1014 is formed from a cylinder that fits within the bore of the sleeve 1012, the fit of the valve spool 1014 being such that it will slide and move axially in the outer sleeve 1012 but will prevent fluid flow through any of the ports, 1083 to 1088, that are covered at any time by the valve spool 1014.

The valve spool 1014 has an end projection 1048 that can be acted upon by an actuator to set the position of the valve spool 1014 relative to the outer sleeve 1012.

The outer surface of the valve spool 1014 is formed with an axial groove 1044 that extends over only part of the length of the valve spool 1014 in a direction parallel to the longitudinal axis thereof.

The outer surface of the valve spool 1014 is also formed with an annular groove 1054 which extends around the whole of the circumference of the outer surface of the valve spool 1014.

In use, with the assembled spool valve assembly, axial groove 1044 is suitably disposed on the outer surface of the valve spool 1014 to selectively provide fluid communication between groove 1071 and annular sleeve grooves 1070 and 1072, via ports 1083 to 1085, respectively. Opening and closing of ports 1083 to 1085 in order to selectively provide fluid communication is carried out by rotational movement of the valve spool 1014 relative to the outer sleeve 1012.

Annular groove 1054 is suitably disposed on the outer surface of the valve spool 1014 to, in use, selectively provide fluid communication between groove 1074 and to annular grooves 1073 and 1075, via ports 1086 to 1088, respectively. Opening and closing of ports 1086 to 1088 in order to selectively provide fluid communication is carried out by axial movement of the valve spool 1014 relative to the outer sleeve 1012.

Figure 26:
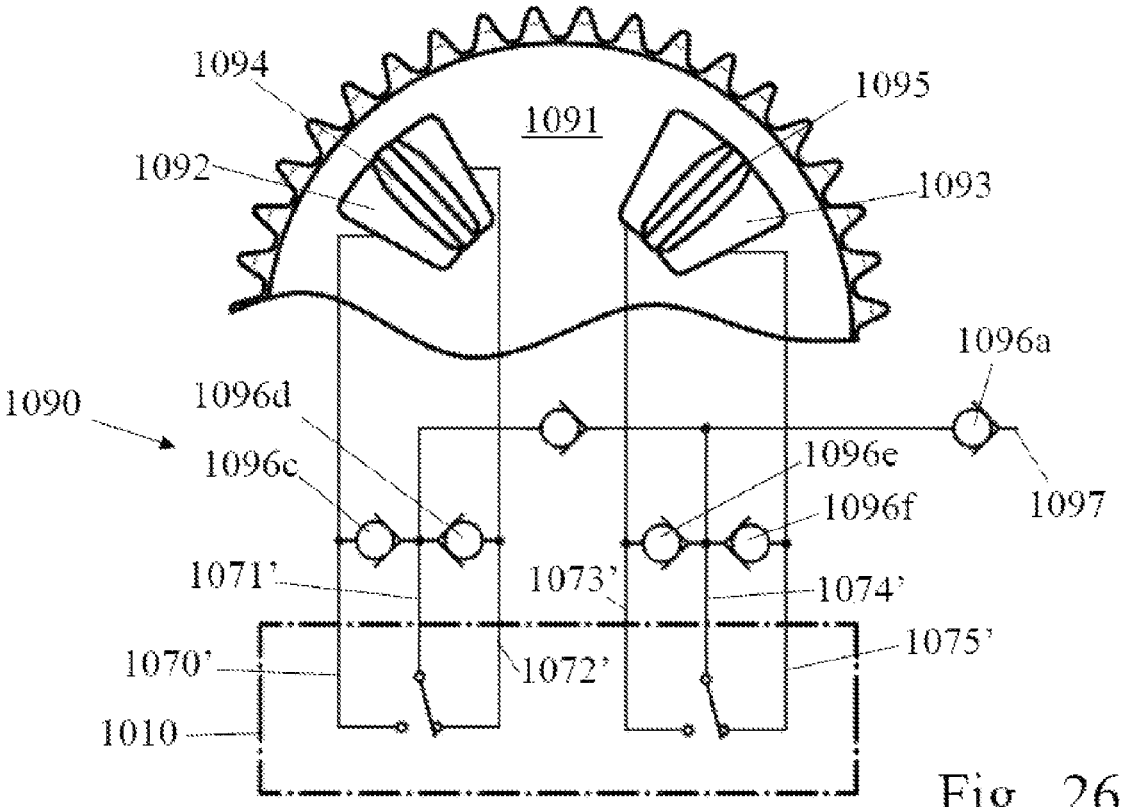
FIG. 26 is a schematic diagram showing a twin torque actuated phaser circuit using the spool valve assembly of FIG. 25.

FIG. 26 is a schematic diagram showing a twin torque actuated phaser circuit 1090 using a spool valve assembly 1010, as described above. A drive member 1091 has cavities, 1092 and 1093, in which vanes 1094 and 1095, are disposed, respectively.

In use, the circuit 1090 provides selective fluid communication between the spool valve assembly 1010 and cavities 1092 and 1093 for controlling the angle of the vanes 1094 and 1095. The circuit 1090 provides the fluid communication through fluid paths 1070', 1071', 1072', 1073', 1074' and 1075', associated with ports 1070 to 1075, respectively, of the spool valve assembly 1010.

Unlike a vane type phaser driven by hydraulic pressure, the torque-actuated phaser only requires a pressurised supply of fluid to provide a top-up. The top-up fluid enters the system from fluid supply 1097 via one way valves 1096*a* and 1096*b*

The angle of the vanes, 1094 and 1095, is controlled by selectively providing a combination of closed and open ports 1083 to 1088, associated with the respective annular grooves 1070 to 1075. This selectively enables fluid to flow through one-way valves 1096*c,d,e* and *f* such that the vanes are able to move towards their required position under the action of the cam drive torques.

Rotation of the valve spool 1014 relative to the outer sleeve 1012 controls the provision of fluid communication from annular groove 1071 to either groove 1070 or groove 1072 and thereby controls the angle of vane 1094 through the associated part of the circuit 1090.

Movement of the valve spool 1014 in an axial direction relative to the outer sleeve 1012 controls the provision of fluid communication from the annular groove 1074 to either groove 1073 or groove 1075 and thereby controls the angle of vane 1095 through the associated part of the circuit 1090.

Figure 27:
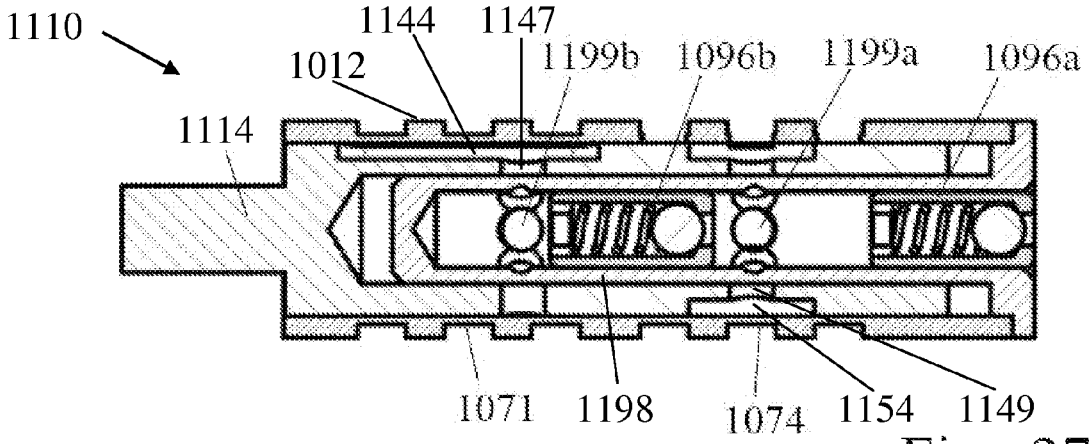
FIG. 27 is a drawing showing a cross-section of an alternative embodiment of a spool valve assembly suitable for use with a torque-actuated phaser.

FIG. 27 is a drawing of an alternative embodiment of a spool valve assembly for use with torque actuated phasers where the top-up feed 1097 is internal to the valve spool. Referring to FIG. 27, a spool valve assembly 1110 has an outer sleeve 1012 and an inner valve spool 1114. The outer sleeve 1012 is the same as that described above in relation to FIG. 25. The valve spool 1114 is similar to valve spool 1014 as described in relation to FIG. 25 except that it has apertures 1147 in the axial groove 1144 and apertures 1149 in the radial groove 1154.

The spool valve assembly 1110 additionally has an inner fluid feed sleeve 1198 which is formed from a cylinder that fits within the hollow bore of the valve spool 1114 in the assembled spool valve assembly 1110. The fluid feed sleeve 1198 also has a hollow blind bore with two sets of ports 1199*a* and 1199*b*. Each set of ports, 1199*a* and 1199*b*, extends around the circumference of the fluid feed sleeve 1198 and each port extends radially through the wall of the fluid feed sleeve 1198.

The sets of ports 1199*a* and 1199*b* provide fluid communication, as required, between the hollow bore, of the fluid feed sleeve 1198, and the annular groove 1154 and grooves 1144, of the valve spool 1114, respectively.

Also fitted within the hollow bore of the fluid feed sleeve 1198 are two one way valves 1096*a* and 1096*b*, wherein a first one way valve 1096*a* is fitted at the open end of the closed bore to selectively allow fluid into the bore and a second one way valve 1096*b* is fitted between the two sets of ports, 1199*a* and 1199*b*, such that it selectively allows fluid in to the second set of ports 1199*b*.

In use, top-up fluid is fed, from a source, into the fluid feed sleeve 1198 through the one-way valves 1096*a* and 1096*b*. The top-up fluid in then fed to the annular grooves 1074 and 1071, via the set of ports, 1199*a* and 1199*b*, respectively.

Figure 28:
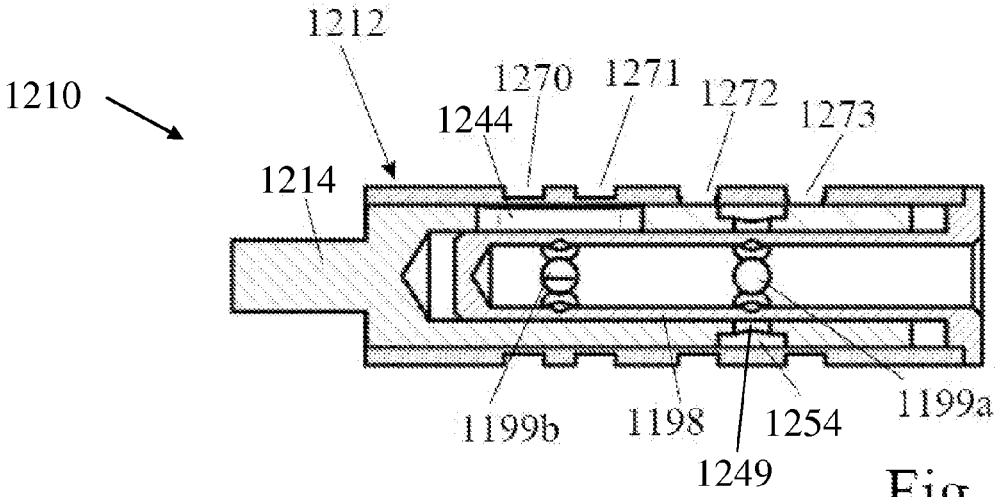
FIG. 28 is a drawing showing a cross-section of another alternative embodiment of a spool valve assembly suitable for use with a torque-actuated phaser.

FIG. 28 shows another alternative embodiment of a spool valve assembly 1210 suitable for use with twin torque-actuated phasers. Compared to the spool valve assembly 1110, as described in relation to FIG. 27, the alternative spool valve assembly 1210 has an outer sleeve 1212 with an alternative arrangement having only four annular grooves 1270, 1271, 1272 and 1723.

Rotational movement of the valve spool 1214 relative to the outer sleeve 1212 controls the feeding of fluid from the hollow bore of the inner fluid feed sleeve 1198 to either annular grooves 1270 or annular grooves 1271, via ports 1199*b* and longitudinal grooves 1244.

Axial movement of the valve spool 1214 relative to the outer sleeve 1212 controls the feeding of fluid from the hollow bore of the inner fluid feed sleeve 1198 to either annular grooves 1272 or annular grooves 1273, via ports 1199*a*, apertures 1249 and annular groove 1254.

Figure 29:
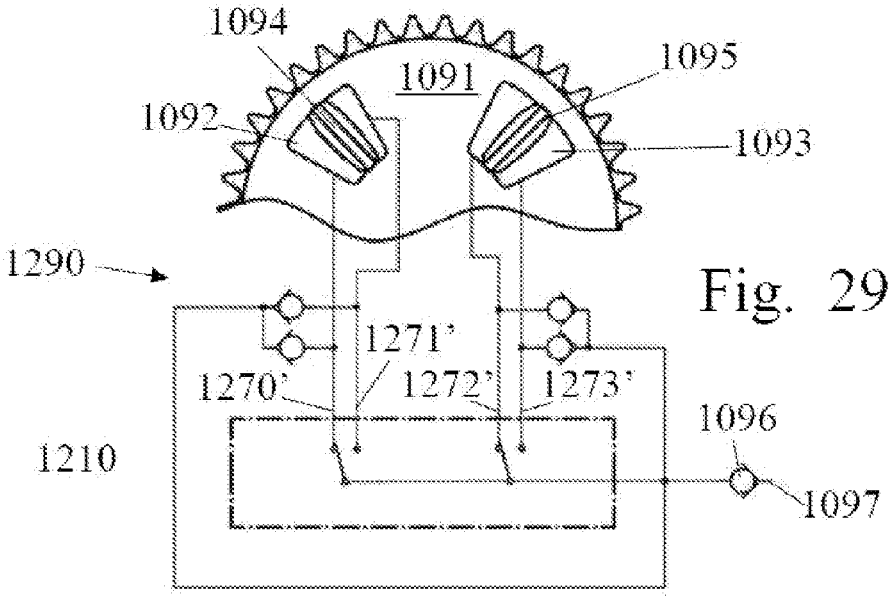
FIG. 29 is a schematic diagram showing a twin torque actuated phaser circuit using the spool valve assembly of FIG. 28.

FIG. 29 is a schematic diagram showing a twin torque actuated phaser circuit 1290 using a valve spool assembly 1210, as described above in relation to FIG. 28.

Referring to both FIGS. 28 and 29, a drive member 1091 has cavities, 1092 and 1093, in which vanes 1094 and 1095, are disposed, respectively.

In use, the circuit 1290 provides selective fluid communication between the spool valve assembly 1210 and cavities 1092 and 1093, for controlling the angle of the vanes 1094 and 1095. The circuit 1290 provides the fluid communication through fluid paths 1270', 1271', 1272' and 1273', associated with ports 1270 to 1273, respectively, of the spool valve assembly 1210.

A top-up supply of fluid is supplied into the hollow bore of the inner fluid feed sleeve 1198 via a one-way valve 1096 from a fluid supply 1097.

The angle of the vanes, 1094 and 1095, is controlled by selectively providing a combination of closed and open fluid paths via ports 1199*b* and 1199*a*, aperture 1249, longitudinal grooves 1244 and annular groove 1254, and their position relative to the ports in annular grooves 1270 and 1271, and 1272 and 1273, respectively. The paths being determined by axial or rotational movement of the valve spool 1214 relative to the outer sleeve 1212, as previously described.

The advantage of this embodiment is that it has fewer (i.e., four) annular grooves and therefore the spool valve assembly 1210 is significantly shorter in length than the previously described spool valve assembly 1110 (see FIG. 27).

The present invention is not limited to embodiments described herein; reference should be had to the appended claims.

The invention claimed is:

1. A spool valve for controlling a twin phaser for coupling a drive member to two driven members and for enabling a phase of each of the two driven members to be varied independently relative to the drive member, the spool valve comprising:

a bore configured to be operably associated with the twin phaser;

fluid channels opening into the bore; and a spool configured to be received in and be moveable relative to the bore so as to selectively open and close the fluid channels in a predetermined manner so as to provide a fluid communication between the spool and the twin phaser so as to vary a phase of output members relative to an input member, wherein, the spool and the fluid channels are configured so that an axial displacement of the spool relative to the bore serves to control a phase of a first output member, and a rotation of the spool relative to the bore serves to control a phase of a second output member.

2. The spool valve as recited in claim 1, further comprising an outer sleeve comprising an inner bore, wherein the outer sleeve is configured to surround the spool, the outer sleeve being configured to be received in and be operatively associated with a bore of the twin phaser.

3. The spool valve as recited in claim 2, wherein the outer sleeve further comprises an outer surface comprising annular grooves, the annular grooves being arranged so as to be spaced apart along at least a part of a longitudinal length of the outer sleeve.

4. The spool valve as recited in claim 3, wherein each of the annular grooves comprises at least one opening, the at least one opening forming a part of the fluid channels.

5. The spool valve as recited in claim 2, further comprising sealing rings disposed on the outer sleeve, the sealing rings being configured to provide a seal between the outer sleeve and the bore of the twin phaser.

6. The spool valve as recited in claim 1, further comprising a biasing device configured to resiliently bias the spool in at least one of an axial direction and a rotational direction relative to an operably associated bore.

7. The spool valve as recited in claim 1, wherein the spool comprises open-ended circumferentially spaced longitudinal grooves.

8. The spool valve as recited in claim 1, wherein the spool comprises circumferentially spaced discrete longitudinal grooves arranged to extend over only a part of a length of the spool.

9. The spool valve as recited in claim 8, wherein the spool further comprises a spool bore, and each of the circumferentially spaced discrete longitudinal grooves comprises an opening configured to provide a fluid communication between the spool bore and a respective circumferentially spaced discrete longitudinal groove.

10. The spool valve as recited in claim 1, wherein the spool comprises open-ended circumferentially spaced longitudinal grooves, and circumferentially spaced discrete longitudinal grooves arranged to extend over only a part of a length of the spool, wherein the open-ended circumferentially spaced longitudinal grooves and the circumferentially spaced discrete longitudinal grooves are arranged so as to be circumferentially inter-disposed relative to each other.

11. The spool valve as recited in claim 10, wherein the spool further comprises an outer surface and slots arranged to be circumferentially spaced apart on the outer surface and to be substantially axially aligned with the circumferentially spaced discrete longitudinal grooves.

12. The spool valve as recited in claim 11, wherein the spool further comprises a radial groove extending completely around an outer circumference of the outer surface of the spool, the radial groove being configured to interconnect with the open-ended circumferentially spaced longitudinal grooves and to remain discrete from the circumferentially spaced discrete longitudinal grooves and the slots.

13. The spool valve as recited in claim 10, further comprising a feed sleeve disposed in the spool bore of the spool, the feed sleeve being configured to provide a fluid communication to the fluid channels depending on a position of the feed sleeve relative to the spool.

14. The spool valve as recited in claim 13, wherein the feed sleeve comprises two sets of spaced apart openings and an inner bore, each one of the two sets of spaced apart openings extending around an outer circumference of the feed sleeve so as to provide a fluid communication between the inner bore of the feed sleeve and the spool.

15. The spool valve as recited in claim 14, wherein the feed sleeve further comprises two one-way valves configured to control a fluid entering into at least one portion of the inner bore of the feed sleeve.

* * * * *